US011649976B1

(12) United States Patent
Galvin

(10) Patent No.: US 11,649,976 B1
(45) Date of Patent: May 16, 2023

(54) AIR-WALL ROOM SYSTEM

(71) Applicant: Patric N. Galvin, Arvada, CO (US)

(72) Inventor: Patric N. Galvin, Arvada, CO (US)

( * ) Notice: Subject to any disclaimer, the term of this patent is extended or adjusted under 35 U.S.C. 154(b) by 267 days.

(21) Appl. No.: 17/212,241

(22) Filed: Mar. 25, 2021

Related U.S. Application Data

(60) Provisional application No. 63/000,203, filed on Mar. 26, 2020.

(51) Int. Cl.
*F24F 9/00* (2006.01)
*F24F 3/163* (2021.01)
*F24F 7/08* (2006.01)

(52) U.S. Cl.
CPC ..... *F24F 9/00* (2013.01); *F24F 3/163* (2021.01); *F24F 7/08* (2013.01); *F24F 2009/002* (2013.01)

(58) Field of Classification Search
CPC ..... F24F 9/00; F24F 3/163; F24F 7/08; F24F 2009/002; F24F 2009/007; F25D 23/023
USPC ..... 454/188, 189, 190, 191, 192, 193
See application file for complete search history.

(56) References Cited

U.S. PATENT DOCUMENTS 5,306,207 A * 4/1994 Courts ..... F16L 3/14 411/401
2006/0090746 A1* 5/2006 Lee ..... F24C 15/2028 126/299 D
2007/0113839 A1* 5/2007 Lee ..... F24C 15/2028 126/299 D

FOREIGN PATENT DOCUMENTS

KR 20190124886 A * 11/2019

OTHER PUBLICATIONS

English translation of KR-20190124886-A.*

* cited by examiner

*Primary Examiner* — Steven B McAllister
*Assistant Examiner* — Charles R Brawner
(74) *Attorney, Agent, or Firm* — Edwin H. Crabtree; Ramon L. Pizarru

(57) ABSTRACT

An air-wall room system, suspended from a room ceiling, having a compressed air discharge duct. The air discharge duct is used for circulating compressed air into a hollow, four sided, upper air-wall frame with air openings. The air from the upper air-wall frame is circulated into a work space. The hollow upper air-wall frame includes air discharge ports for creating an air-wall. The air-wall, similar to a curtain, prevents toxic gases from escaping outside the work space. Corners of the upper air-wall frame are attached to vertical frame members. A bottom of the vertical frame members is attached to corners of a hollow, four sided, lower air-wall frame. The lower air-wall frame includes vacuum ports for receiving the bottom of the air-wall. A side of the lower air-wall frame is connected to a vacuum air exhaust duct. The air exhaust duct is used for drawing a vacuum in the hollow lower air-wall frame and exhausting the air-wall out a vacuum air exhaust duct.

9 Claims, 2 Drawing Sheets

12
10
22
28
26
30
32
18
24
36
38
20
14
16
17
40
34

AIR-WALL ROOM SYSTEM

BACKGROUND OF THE INVENTION

(a) Field of the Invention

This invention relates to an air-wall room system, and more particularly, but not by way of limitation, to an air-wall room system, without structural walls, for venting toxic gases, explosive gases, noxious odors, high volumes of dust, and the like, from a work room. The air-wall room system is designed to provide a safe work environment, particularly in the handling of oil extraction from a cannabis plant.

(b) Discussion of Prior Art

Heretofore, there have been a number of different types of work area rooms and enclosures used in the cannabis sector. This sector uses light organics, such as butane, propane, and ethanol to extract TCB and CBD oils from the cannabis plant.

Oil extraction operations can cause explosions or fires if a level of the gas released is between the lower explosive limit (LEL) and the upper explosive limit (UEL) of the combustible air-gas ratio. Currently, these exhaust operations are conducted within a Class 1 Division 1 or Class 1, Division 2 enclosure using hard walls and Underwriter Laboratory Certified spark-free, explosion proof, electrical devices, such as light systems, electrical outlets, gas and odor sensors, fans, and similar utilities. The devices used within these enclosures are installed to prevent hazards to the operators, such as fires or explosives.

The subject invention is designed to eliminate a physical wall structure around the oil extraction operation and similar clean room systems.

SUMMARY OF THE INVENTION

In view of the foregoing, it is a primary objective of the subject invention to provide an air-wall room system, without structural walls, for venting toxic gases, explosive gases, noxious odors, high volumes of dust, and the like, from a work room.

Another object of in the invention is for the air-wall system to provide a safe work environment for workers, particularly in the handling of oil extraction from a cannabis plant.

The air-wall room system is suspended from a room ceiling and includes a compressed air discharge duct. The air discharge duct is used for circulating compressed air into a hollow, four sided, upper air-wall frame with air openings. The air from the upper air-wall frame is then circulated into a work space. The hollow upper air-wall frame includes air discharge ports for creating an air-wall. The air-wall, similar to a curtain, prevents toxic gases from escaping outside the work space. Corners of the upper air-wall frame are attached to vertical frame members. A bottom of the vertical frame members is attached to corners of a hollow, four sided, lower air-wall frame. The lower air-wall frame includes vacuum ports for receiving the bottom of the air-wall. A side of the lower air-wall frame is connected to a vacuum air exhaust duct. The air exhaust duct is used for drawing a vacuum in the hollow lower air-wall frame and exhausting the air-wall out a vacuum air exhaust duct.

These and other objects of the present invention will become apparent to those familiar with different types of laboratory wall systems when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject air-wall room system, and in which.

DESCRIPTION OF THE PREFERRED EMBODIMENTS

Figures 1, 2, 3, 4:
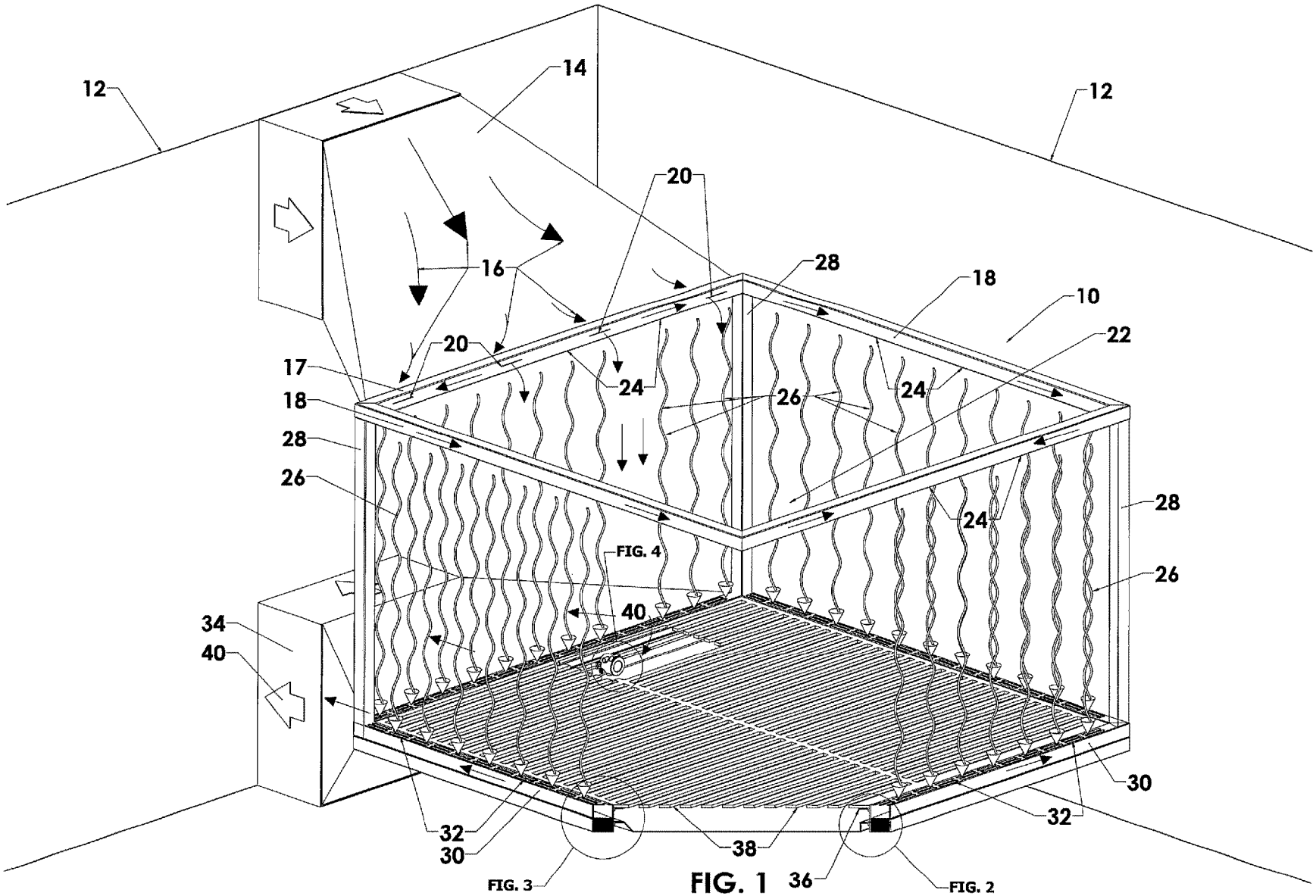
FIG. 1 is a perspective view of the subject air-wall room system suspended from a ceiling and including a compressed air discharge duct, upper and lower air-wall frames, a raised floor with air vents, and a vacuum air exhaust duct.
FIGS. 2 and 3 are cut-way perspective views of a portion of the lower air-wall frame and the raised floor with air vents.
FIG. 4 is a perspective view of a gas sensor disposed next to an air vent in the raised floor.
Figure 3:
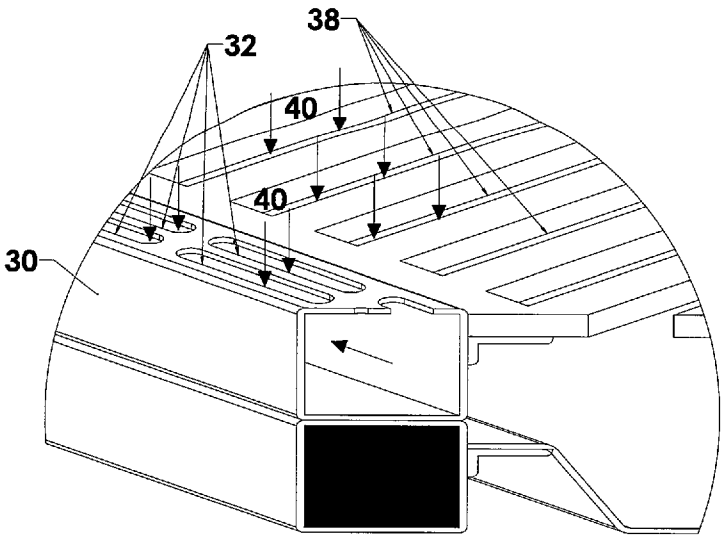
Figure 2:
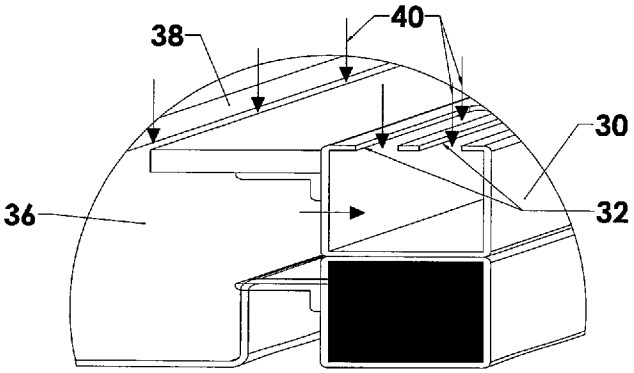
Figure 4:
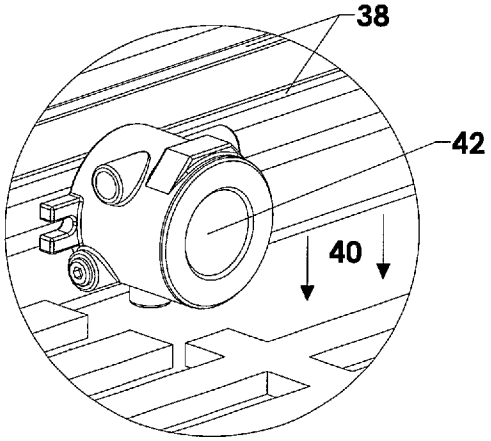

In FIG. 1, a perspective view of the subject air-wall room system is illustrated and having general reference number 10. The air-wall room system 10 is suspended from a room ceiling 12. The system 10 includes a compressed air discharge duct 14 for circulating compressed air, indicated by arrows 16, into a hollow, four sided, upper air-wall frame 18. One side 17 of the upper air-wall frame 18 includes air openings 20 for receiving the compressed air therein. Also, the air 16 is circulated outwardly through the air openings 20 into a work space 22 and between the sides of the frame 18. The work space 22 is used for cannabis oil extraction and other applications.

The hollow upper air-wall frame 18 includes air discharge ports 24 along it's length and in the bottom of the frame 18 for creating an air-wall, shown as vertical arrows 26. The air-wall 26, extending downwardly and similar to a curtain, eliminates the need for a hard wall structure and prevents toxic gases and the like from escaping outside the work space 22.

Extending downwardly from corners of the upper air-wall frame 18 are vertical frame members 28, typically 8 to 10 feet in length for providing a sufficient height for the workmen in the work space 22. The bottom of the vertical frame members 28 are attached to corners of a hollow, four sided, lower air-wall frame 30. The lower air-wall frame 30 includes vacuum ports 32 for receiving the bottom of the air-wall 26. A side of the frame 30 is connected to a vacuum air exhaust duct 34 for drawing a vacuum in the hollow lower air-wall frame 30 and exhausting the air-wall 26 out the duct 34.

The lower air-wall frame 30 surrounds an elevated floor 36 with air exhaust vents 38. One side of the elevated floor 36 is connected to the exhaust duct 34. The toxic air, shown as arrows 40, is shown being drawn into the exhaust vents 38 and into the exhaust duct 34, thus providing a safe environment for the work space 22. A portion of the floor 36 and the lower air-wall frame 30 is cut away in this drawing.

In FIGS. 2 and 3 a cut-way perspective view of a portion of the lower air-wall frame 30 is shown with the elevated floor 36 and air exhaust vents 38.

In FIG. 4, a perspective view of a gas sensor 42 is shown disposed next to the air exhaust vents 38 in the top of the elevated floor 36. As the toxic air 40 exits the work space 22, the gas sensor 42 will detect the level of gas-air mixture in the workspace and alert the workman when a high level of gas has been detected during the oil extraction operation. This gas sensor will allow for increased air flow or air pressure into the air curtain to be activated at the time of sensing a toxic or flammable gas. The variable air flow will minimize the costs of the HVAC costs for heating and cooling the room and adjacent spaces. This variable air flow is incorporated by reference to U.S. Pat. No. 10,232,286 to Havelick.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. An air-wall room system suspended from a room ceiling, the air-wall room system comprising:

a compressed air discharge duct;

a hollow, four sided, upper air-wall frame with air opening attached to the air discharge duct, the compressed air from the upper air-wall frame receiving compressed air from the air discharge duct, the compressed air from the upper air-wall frame is circulated into a work space surrounded by the upper air-wall frame and, the hollow upper air-wall frame having air discharge ports along it's length for creating an air-wall;

vertical frame members attached to corners of the upper air-wall frame and extending downwardly;

a hollow, four sided, lower air-wall frame attached to a lower end of the vertical frame members, the lower air-wall frame having vacuum ports for receiving a bottom of the air-wall; and a vacuum air exhaust duct attached to one side of the lower air-wall frame, the exhaust duct for drawing a vacuum in the work space and exhausting the air-wall out the vacuum air exhaust duct.

2. The air-wall room system as described in claim 1 wherein the upper air-wall frame includes air discharge ports along one side of the upper air-wall frame for discharging air into the work space and air discharge ports along a bottom of the sides of the upper air-wall frame for discharging compressed air downwardly and creating an air-wall on the sides of the work space.

3. The air-wall room system as described in claim 1 further including an elevated floor with air exhaust vents, one side of the elevated floor connected to the vacuum air exhaust duct for drawing toxic air from the work space into the exhaust vents and into the exhaust duct.

4. The air-wall room system as described in claim 3 further including a gas sensor disposed next to the exhaust vents in the elevated floor, the gas sensor for detecting the level of gas-air mixture in the work space.

5. An air-wall room system suspended from a room ceiling, the air-wall room system comprising:

a compressed air discharge duct;

a hollow, four sided, upper air-wall frame with air openings attached to the air discharge duct, the upper air-wall frame receiving compressed air from the air discharge duct, the upper air-wall frame including air discharge ports along one side of the upper air-wall frame for discharging air into the work space and air discharge ports along a bottom of the sides of the upper air-wall frame for discharging compressed air downwardly and creating an air-wall on the sides of the work space;

vertical frame members attached to corners of the upper air-wall frame and extending downwardly;

a hollow, four sided, lower air-wall frame attached to a lower end of the vertical frame members, the lower air-wall frame having vacuum ports for receiving a bottom of the air-wall; and a vacuum air exhaust duct attached to one side of the lower air-wall frame, the exhaust duct for drawing a vacuum in the work space and exhausting the air-wall out the vacuum air exhaust duct.

6. The air-wall room system as described in claim 5 further including an elevated floor with air exhaust vents, one side of the elevated floor connected to the vacuum air exhaust duct for drawing toxic air from the work space into the exhaust vents and into the exhaust duct.

7. The air-wall room system as described in claim 5 further including a gas sensor disposed next to the exhaust vents in the elevated floor, the gas sensor for detecting the level of gas-air mixture in the work space.

8. An air-wall room system suspended from a room ceiling, the air-wall room system comprising:

a compressed air discharge duct;

a hollow, four sided, upper air-wall frame with air openings attached to the air discharge duct, the upper air-wall frame receiving compressed air from the air discharge duct, the upper air-wall frame including air discharge ports along one side of the upper air-wall frame for discharging air into the work space and air discharge ports along a bottom of the sides of the upper air-wall frame for discharging compressed air downwardly and creating an air-wall on the sides of the work space;

vertical frame members attached to corners of the upper air-wall frame and extending downwardly;

a hollow, four sided, lower air-wall frame attached to a lower end of the vertical frame members, the lower air-wall frame having vacuum ports for receiving a bottom of the air-wall; a vacuum air exhaust duct attached to one side of the lower air-wall frame, the exhaust duct for drawing a vacuum in the work space and exhausting the air-wall out the vacuum air exhaust duct; and an elevated floor with air exhaust vents, one side of the elevated floor connected to the vacuum air exhaust duct for drawing toxic air from the work space into the exhaust vents and into the exhaust duct.

9. The air-wall room system as described in claim 8 further including a gas sensor disposed next to the exhaust vents in the elevated floor, the gas sensor for detecting the level of gas-air mixture in the work space.

* * * * *